United States Patent [19]

McCaffrey et al.

[11] 4,416,769

[45] Nov. 22, 1983

[54] FROTH FLOTATION

[75] Inventors: David J. A. McCaffrey, Cheltenham, England; William D. Jones, deceased, late of Tewkesbury, England, by Barbara Jones, legal representative

[73] Assignee: Coal Industry (Patents) Limited, London, England

[21] Appl. No.: 334,237

[22] Filed: Dec. 24, 1981

[51] Int. Cl.[3] ..... B03D 1/14

[52] U.S. Cl. ..... 209/166; 209/167; 210/704

[58] Field of Search ..... 209/166, 167; 210/704, 210/705; 208/15

[56] References Cited

U.S. PATENT DOCUMENTS

| | | | |
|---|---|---|---|
| 1,329,493 | 2/1920 | Bacon | 209/167 |
| 2,377,129 | 5/1945 | Christmann | 209/166 |
| 2,695,101 | 11/1954 | Booth et al. | 209/166 |
| 4,222,861 | 9/1980 | Finch | 209/166 |
| 4,340,467 | 7/1982 | Wang et al. | 209/166 |

FOREIGN PATENT DOCUMENTS

| | | |
|---|---|---|
| 609131 | 9/1948 | United Kingdom . |
| 780021 | 4/1957 | United Kingdom . |
| 1339337 | 12/1973 | United Kingdom . |
| 1334024 | 1/1974 | United Kingdom . |
| 2010702 | 7/1979 | United Kingdom . |

*Primary Examiner*—Bernard Nozick

*Attorney, Agent, or Firm*—Stevens, Davis, Miller & Mosher

[57] ABSTRACT

This invention relates to froth flotation of coal.

According to the invention a predominantly paraffinic residual oil having a cut point of at least 190° C. at atmospheric pressure is used as a "collector" for the froth flotation of minerals. A preferred oil is a coal spray oil used in coke oven technology. The "collector" is for use with a "frother" such as a polyglycol ether.

5 Claims, No Drawings

FROTH FLOTATION

This invention concerns improvements in froth flotation, especially the froth flotation of coal.

The technique of froth flotation of minerals is well known in the art, and is described in the literature, for example "Handbook of Mineral Dressing" by A. F. Taggart, John Wiley & Sons, 1954, Section 12. In the coal industry, froth flotation is used to treat suspensions of coal fines which are difficult to treat in any other way. Conventional techniques involve the addition of a froth flotation oil to the suspension of the mineral and the passage of air through the suspension to create bubbles which carry the fine mineral to the surface to form a froth rich in minerals, the froth then being removed and the mineral recovered therefrom. The froth flotation oil may be a single compound or mixture of compounds of similar characteristics, but it is modern good practice, at least in the coal industry, to use a combination of a "frother" and a "collector". The "frothers" usable are of classes broadly known in the art, and the "collector" is usually a hydrocarbon oil of which distillate oils such as kerosene, industrial diesel fuel and furnace oil are the most widely used, especially kerosene. It has been suggested that good collectors for fine coal suspensions are those having a high proportion of aromatic hydrocarbons because of their affinity for the coal which has a polynuclear aromatic structure.

The present invention is based on the discovery that instead of the distillate oils commonly used as "collectors", a residual oil can be used which offers certain advantages in selectivity.

The present invention provides the use of a predominantly paraffinic residual oil having a cut point of at least 190° C. at atmospheric pressure as a "collector" for the froth flotation of minerals.

The invention also provides a method of treating minerals by froth flotation comprising the operation of a froth flotation cell using a "collector" which is a predominantly paraffinic residual oil having a cut point of at least 190° C. at atmospheric pressure.

The residual oil has preferably no, or less than 10%, especially less than 6%, of aromatic present and preferably has no, or only a small proportion (e.g. less that 10%, especially less than 5%), of naphthenes. Thus, the residual oil is preferably a mixture of normal and branched alkanes greater than 80% in total, more preferably greater than 89%, by wt. A preferred residual oil is that which has been used as a coal spray oil, which is used to spray coal in coke over technology. Coal spray oil can be prepared by removing all components boiling up to 190° C. by distillation from a natural or petroleum gas condensate.

The "collector" of the invention may be used together with a conventional "frother". A preferred "frother" is a polyglycol ether, and these are commercially available. The "frother" may be present in admixture with the collector in an amount of up to 40%, suitably 10 to 20%, but the "collector" and "frother" may be fed separately to the froth flotation cell. While the "collector" of the invention is particularly useful for the froth flotation of coals, it is also applicable to any mineral requiring an oily "collector", of which talc and the titanium ore illmanite may be mentioned.

The invention will now be described by way of Example.

EXAMPLE

A residual oil was obtained by distilling off components boiling up to 190° C. from a North Sea petroleum gas condensate and contained less than 2% of aromatics and less than 2% of naphthenes.

A mixture of this residual oil and a commercially available conventional polyglycol ether "frother" in an amount of 10% by weight was used in conventional amounts in a conventional full scale froth flotation cell fed with a suspension of fine coal which was an effluent stream from a colliery coal preparation plant. The cell operated completely satisfactorily and it was found that there was a reduction of ash content in the coal-rich froth, compared with the use of known "collector" and "frother".

The above-mentioned mixture was used at a colliery coal preparation plant which had been using a commercial phenolic froth flotation solution consisting of "collector" and a "frother" and which had experienced difficulty in keeping ash-in-froth consistently below 12% for the production of coking coals. Using the mixture of the invention, the ash-in-froth was consistently below 12% and averaged 1.5 percentage points improvement compared to previous practice, each taken over a one week period. Ash-in-tailings were consistently greater than the target figure of 70%.

Excellent results have been found with mixtures of the above residual oil and amounts of 15% by weight of the above-mentioned "frother". The mixture containing 15% of "frother" was used in a laboratory cell at a range of dosage rates from 0.2 to 1 liters/tonne of coal slurry. Froth yields, that is the weight percentage of dried froth against solids content of the initial charge of coal slurry, varied from 28 to 64% giving several percentage points increase in yield compared with a commercial froth flotation solution recognised as a "state-of-the-art" product (containing 15% by weight of the same "frother" in admixture with a highly aromatic kerosene hydrocarbon collector) at dosage rates above about 0.5 liters/tonne. The kerosene collector used in the commercial product contained 20% of aromatics and 26% naphthenes and 54% of n-and branched-chain alkanes, and has a distillate boiling from approximately 170° to 280° C.

We claim:

1. A method of treating coal by froth flotation comprising the operation of a froth flotation cell using a "collector" consisting essentially of a paraffinic residual oil having a cut point of at least 190° C. at atmospheric pressure and which has less than 10% of aromatics and less than 10% of naphthenes therein, by weight and recovering coal in the froth.

2. A method as claimed in claim 1, wherein the residual oil has less than 6% of aromatics and less than 5% of naphthenes therein, by weight.

3. A method as claimed in claim 1, wherein the residual oil is the +190° C. residual of distillation of a natural or petroleum gas condensate.

4. A method as claimed in claim 1, wherein the "collector" is used in association with a polyglycol ether "frother".

5. A method as claimed in claim 4, wherein the polyglycol ether "frother" is present in admixture with the "collector" in an amount of 10–20% by weight.

* * * * *